US008444192B2

(12) United States Patent
Pavlic

(10) Patent No.: US 8,444,192 B2
(45) Date of Patent: May 21, 2013

(54) PITCH ADJUSTABLE BI-DIRECTIONAL SHOVEL

(76) Inventor: John Pavlic, Middlefield, OH (US)

( * ) Notice: Subject to any disclaimer, the term of this patent is extended or adjusted under 35 U.S.C. 154(b) by 61 days.

(21) Appl. No.: 12/980,982

(22) Filed: Dec. 29, 2010

(65) Prior Publication Data

US 2011/0181065 A1 Jul. 28, 2011

Related U.S. Application Data

(60) Provisional application No. 61/298,050, filed on Jan. 25, 2010.

(51) Int. Cl.
*F23J 1/04* (2006.01)

(52) U.S. Cl.
USPC ..... 294/9; 294/53.5; 294/181

(58) Field of Classification Search ..... 294/9, 53.5, 294/176, 181; 172/372, 377
See application file for complete search history.

(56) References Cited

U.S. PATENT DOCUMENTS

| | | | | | |
|---|---|---|---|---|---|
| 316,623 | A | | 4/1885 | Hooper | |
| 467,831 | A | | 1/1892 | Reynolds | |
| 736,798 | A | | 8/1903 | Stiefel | |
| 860,102 | A | | 7/1907 | Newman | |
| 976,970 | A | * | 11/1910 | Wolary | 172/372 |
| 1,436,271 | A | | 11/1922 | McCulloch | |
| 1,570,189 | A | * | 1/1926 | Sturm | 294/51 |
| 1,619,266 | A | | 3/1927 | Miller | |
| 2,221,219 | A | * | 11/1940 | Nelson | 294/9 |
| 2,419,719 | A | * | 4/1947 | Kennedy | 172/372 |
| 2,486,434 | A | * | 11/1949 | Plummer | 294/51 |
| 2,505,113 | A | * | 4/1950 | Handley | 294/9 |
| 2,547,846 | A | * | 4/1951 | Annen | 294/9 |
| 3,749,262 | A | | 7/1973 | Stark | |
| 3,810,320 | A | | 5/1974 | Siebert | |
| 4,619,474 | A | | 10/1986 | Dauphinais | |
| 4,948,188 | A | | 8/1990 | Haslam | |
| 5,431,468 | A | | 7/1995 | Rosenshine | |
| 5,456,509 | A | * | 10/1995 | Martin et al. | 294/9 |
| 5,520,429 | A | | 5/1996 | Gregory | |
| 5,548,864 | A | * | 8/1996 | Vosbikian et al. | 15/257.7 |
| 5,630,633 | A | | 5/1997 | Dupre et al. | |
| 5,791,707 | A | | 8/1998 | Szakurski | |
| 5,906,060 | A | | 5/1999 | Tonry | |
| 5,906,145 | A | | 5/1999 | Shepherd | |
| 5,984,393 | A | | 11/1999 | Washington | |
| 6,125,720 | A | | 10/2000 | Gohman | |
| 6,237,973 | B1 | | 5/2001 | Dupont et al. | |
| 6,237,975 | B1 | | 5/2001 | Drobot | |
| 6,269,558 | B1 | | 8/2001 | Alexander | |
| 6,315,341 | B1 | | 11/2001 | Leon et al. | |
| 6,334,640 | B1 | | 1/2002 | Werner et al. | |

(Continued)

*Primary Examiner* — Dean Kramer
(74) *Attorney, Agent, or Firm* — Fay Sharpe LLP

(57) ABSTRACT

A pitch adjustable bi-directional shovel includes a substantially flat blade including a forward edge and a rearward edge. Each edge of the blade includes a contact surface. A pivot is secured to the blade. A handle is provided including a first end and a second end, the first end being rotatably mounted to the pivot. An adjustable retention assembly is secured to one or more of the pivot, the blade, or the handle, wherein the pivot and the adjustable retention assembly cooperate to alter the pitch of the blade with respect to the handle so as maintain the blade in general parallel orientation with the associated debris laden surface. The contact surface of the forward edge slideably engages the associated debris laden surface when urged in the forward direction and the contact surface of the rearward edge slideably engages the associated debris laden surface when urged in the rearward direction.

8 Claims, 9 Drawing Sheets

U.S. PATENT DOCUMENTS

| | | | |
|---|---|---|---|
| 6,357,067 | B1 | 3/2002 | Jones |
| 6,675,507 | B2 | 1/2004 | Petruzzelli |
| 7,347,468 | B1 | 3/2008 | Tidcomb |
| 7,380,848 | B2 | 6/2008 | Petruzelli |
| 2006/0214443 | A1 | 9/2006 | Dixon |
| 2007/0013198 | A1 | 1/2007 | Brazeau |
| 2007/0227048 | A1 | 10/2007 | Adinata |
| 2008/0185857 | A1 | 8/2008 | Westgarde et al. |

* cited by examiner

PITCH ADJUSTABLE BI-DIRECTIONAL SHOVEL

A claim for domestic priority is made herein under 35 U.S.C. §119(e) to U.S. Provisional App. Ser. No. 61/298,050 filed on Jan. 25, 2010, the entire disclosure of which is incorporated herein by reference.

BACKGROUND

The present application relates to the general field of shovel and debris removal devices. In particular, the present application pertains to shovel devices for the efficient removal of ash or other debris from a furnace, stove, firebox, pit, etc. However, other applications are also contemplated.

With the ever rising cost of energy (e.g., electricity, oil, and natural gas) more and more individuals are returning to wood and/or coal burning heating systems to heat their homes and businesses. In addition, the use of modern electronics and controls have made these systems ever more efficient and compact, such that they can be seamlessly used in most commercial and/or residential HVAC systems. Of course, the combustion of wood and/or coal still involves the production of solid byproducts (i.e., carbon, ash, cinders, etc.) that have to be removed from an ash or debris compartment of the system on a regular basis. The prior art devices typically involve a shovel that is small enough to fit through a narrow opening provided in the system for the removal of such debris. However, due to the compact nature of these heating systems, efficient and effective removal of the resultant byproducts or associated debris is not possible.

In general, the prior art shovel or debris removal devices do not work or perform adequately given the compact and confined nature of the debris compartment. The confined space of the debris compartment coupled with the typically narrow access window or opening severely restricts the maneuverability of the shovel, particularly in and around the extreme ends or areas of the debris compartment or container. For example, the corners of the compartment often present the greatest challenge since the prior art shovels either cannot reach the corners, are obstructed by the opening or access window, and/or lack the proper blade geometry to effectively scrape and pickup the associated debris.

In addition, the prior art shovels are adapted to be used in a single (typically forward) direction. As such, the user of such a prior art shovel can only pickup debris in a single direction. This has at least two consequences. First, the user is limited in that only debris in front of the prior art shovel can be picked up, thus neglecting everything behind the shovel. Second, the continuous uni-directional motion of the prior art shovel tends to push the debris towards one end of the debris compartment (typically the rear portion) where it becomes even more difficult to reach and extract.

As such, several deficiencies exist with the prior art debris removal shovel devices. For at least these reasons, a need exists to provide an improved debris removal shovel while overcoming the aforementioned problems and others.

SUMMARY

According to one aspect of the present disclosure, a pitch adjustable ash shovel for removing ash debris from an associated ash laden surface is provided. The adjustable ash shovel includes a blade having a transverse forward edge. The forward edge of the blade includes a contact surface for slideably engaging the associated ash laden surface. A pivot is secured to the blade. The pivot includes an axis of rotation generally parallel to the forward edge of the blade. A handle is provided which includes a first end and a second end. The first end is rotatably mounted to the pivot. An adjustable retention assembly is secured to one or more of the pivot, the blade, or the handle. The pivot and the adjustable retention assembly cooperate to alter the pitch of the blade with respect to the handle.

According to another aspect of the present disclosure, a bi-directional ash shovel capable of ash removal in both a forward direction and a rearward direction is provided. The shovel includes a blade including a forward edge and a rearward edge. The forward edge and rearward edge each have a contact surface for slideably engaging an associated ash laden surface. A handle is provided which includes a first end and a second end. The first end is secured to the blade between the forward edge and the rearward edge. The contact surface of the forward edge slideably engages the associated ash laden surface when urged in the forward direction and the contact surface of the rearward edge slideably engages the associated ash laden surface when urged in the rearward direction. Thus, the ash to be removed accumulates on the blade of the shovel in both of the forward and rearward directions.

According to yet another aspect of the present disclosure, a pitch adjustable bi-directional shovel for the removal of debris from an associated debris laden surface is provided. The shovel includes a substantially flat blade including a forward edge and a rearward edge, each of the forward edge and the rearward edge of the blade having a contact surface for slideably engaging the associated debris laden surface. A pivot is secured to the blade. A handle is provided including a first end and a second end, the first end being rotatably mounted to the pivot. An adjustable retention assembly is secured to one or more of the pivot, the blade, or the handle, wherein the pivot and the adjustable retention assembly cooperate to alter the pitch of the blade with respect to the handle so as to facilitate maintaining the blade in general parallel orientation with the associated debris laden surface. The contact surface of the forward edge slideably engages the associated debris laden surface when urged in the forward direction and the contact surface of the rearward edge slideably engages the associated debris laden surface when urged in the rearward direction, so as to accumulate the associated debris on the blade of the shovel in both of the forward and rearward directions.

BRIEF DESCRIPTION OF THE DRAWINGS

The invention may take form in various components and arrangements of components and various steps and arrangement of steps. The drawings are only for purposes of illustrating various embodiments of the instant disclosure and are not to be construed as limiting same.

DETAILED DESCRIPTION

Figure 1:
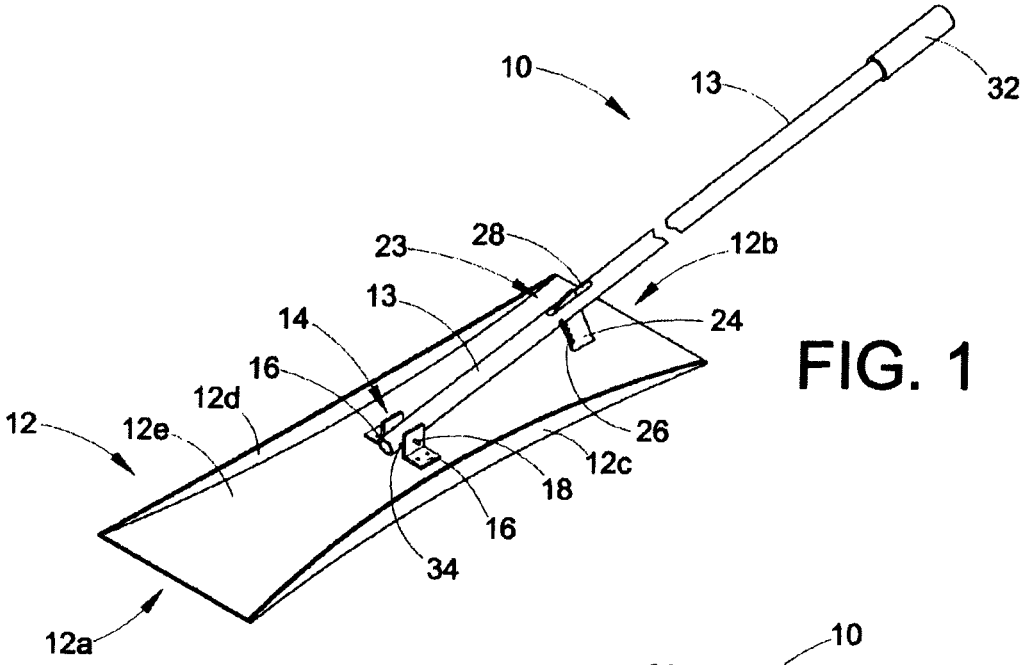
FIG. 1 is a perspective view of a first embodiment of a pitch adjustable and/or bi-directional shovel, according to the present disclosure.
Figure 2:
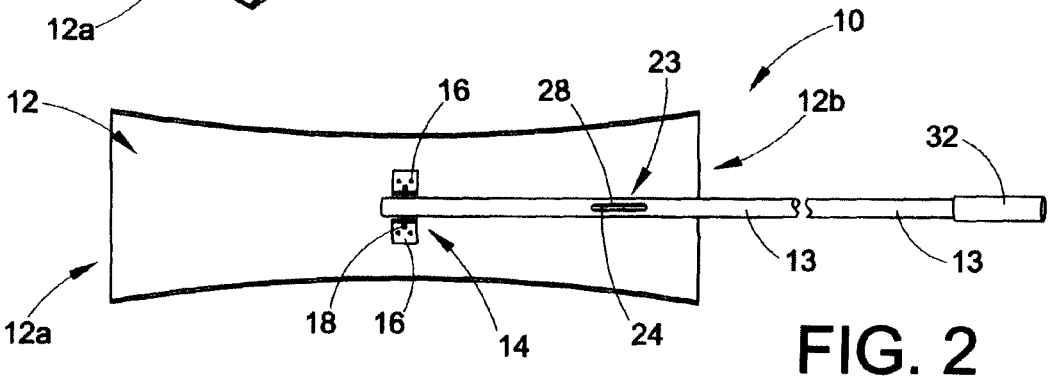
FIG. 2 is a top view of the shovel of FIG. 1.
Figure 3:
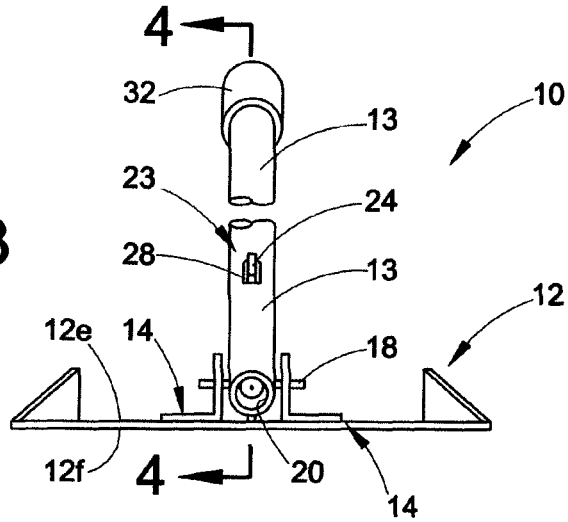
FIG. 3 is a front elevational view of the shovel of FIG. 1.
Figure 4A:
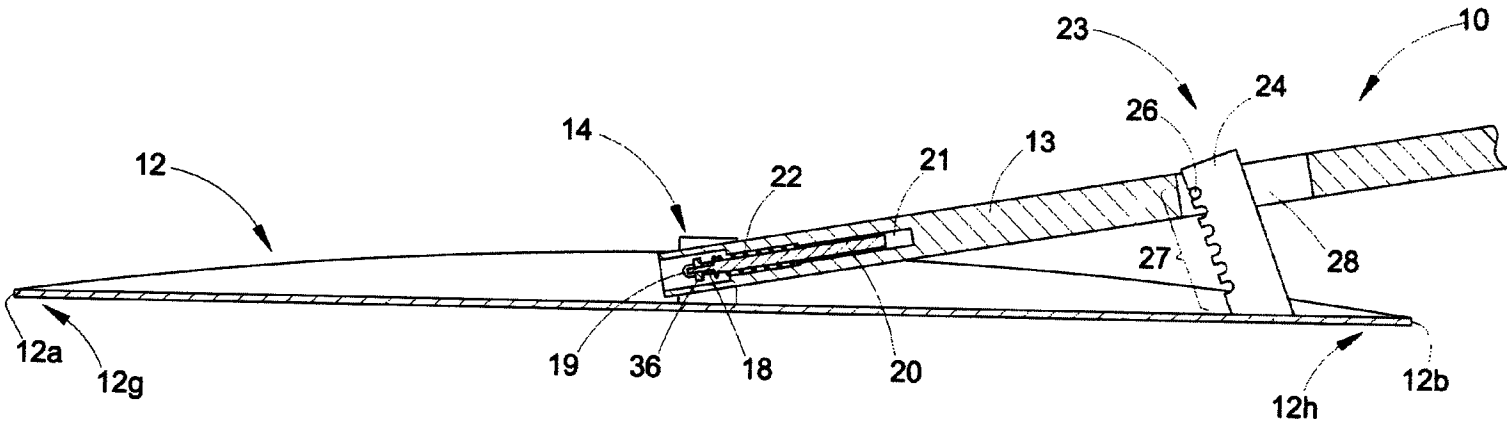
FIG. 4A is a cross sectional view of the shovel of FIG. 3, along a section line 4-4, illustrating a handle of the shovel in an upper most and engaged position.
Figure 4B:
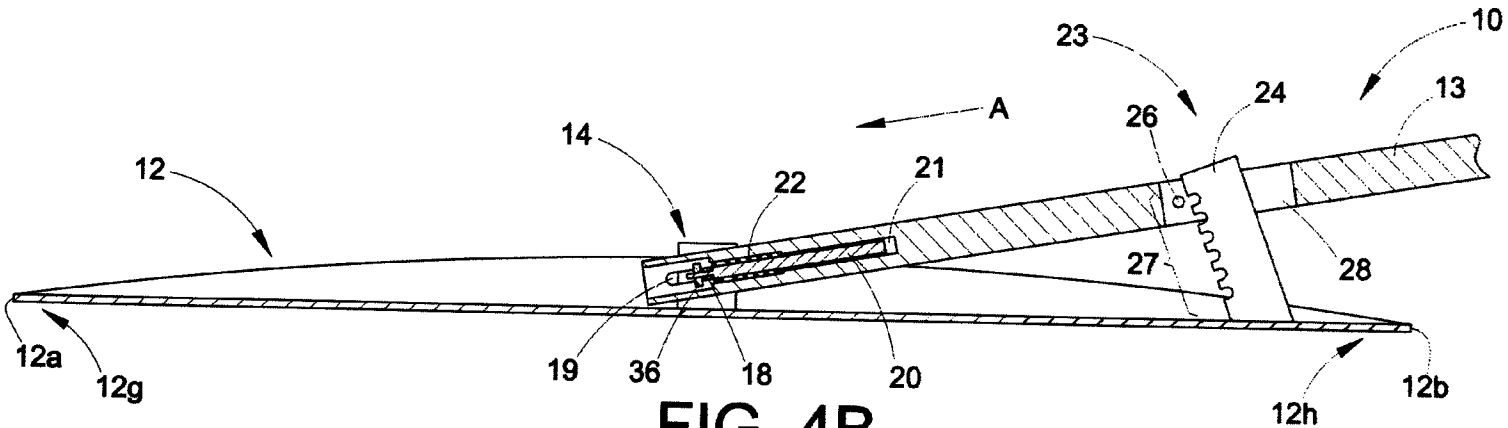
FIG. 4B is a section view of the shovel as shown in FIG. 4A, illustrating the handle in a forward and disengaged position.
Figure 4C:
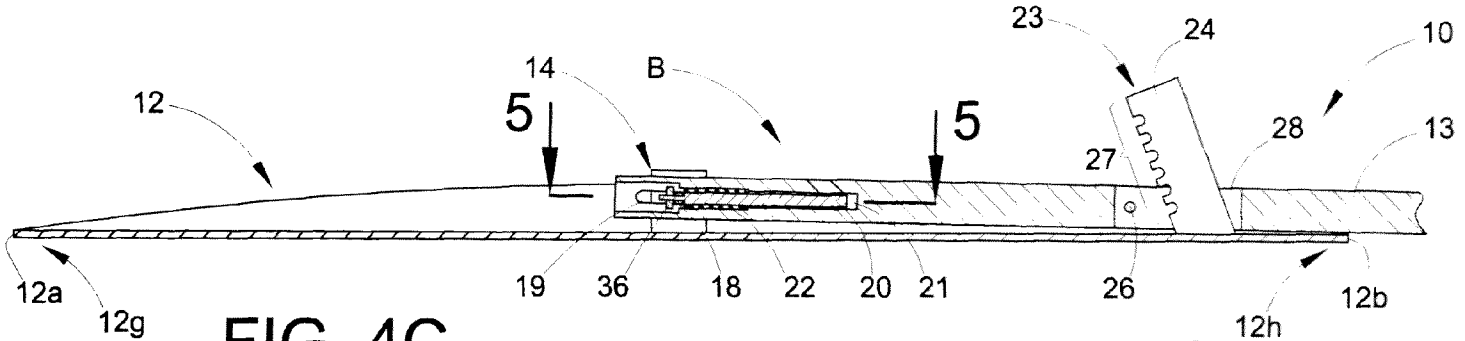
FIG. 4C is a section view of the shovel of FIG. 1 with the handle in a lower most and disengaged position.
Figure 4D:
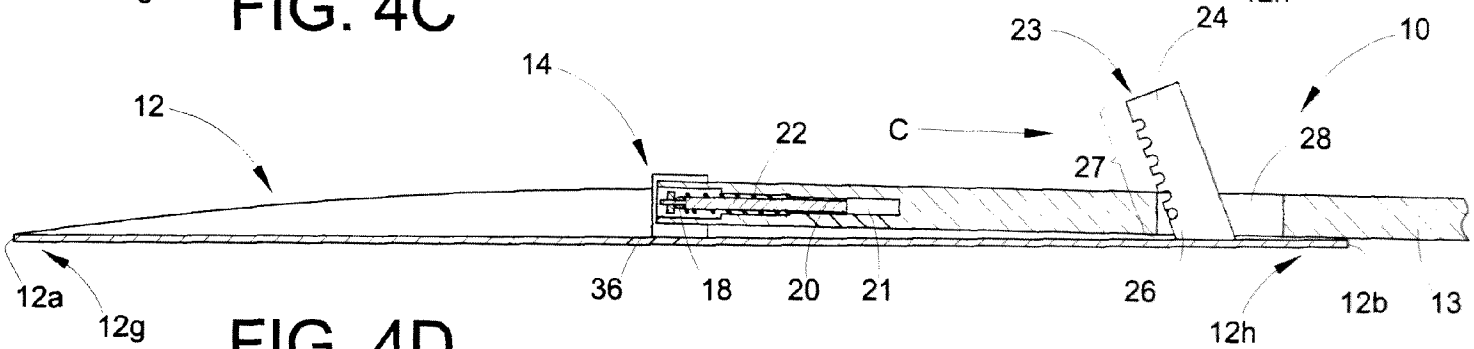
FIG. 4D is a section view of the shovel of FIG. 1 illustrating the handle in a lower most and engaged position.
Figure 5:
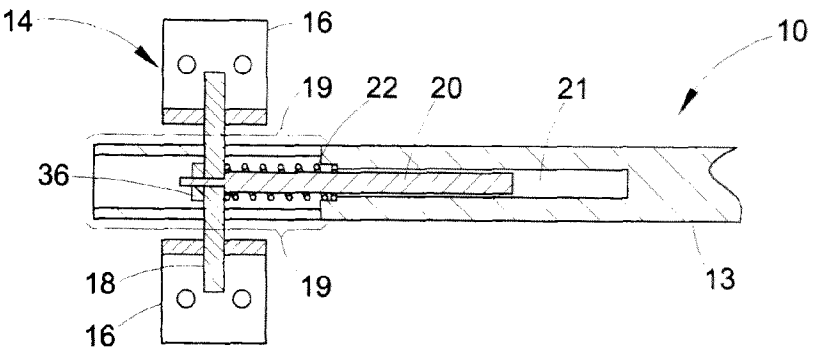
FIG. 5 is a detailed section view of the shovel taken along a section line 5-5 of FIG. 4C, illustrating a pivot and a portion of an adjustable retention assembly.

With reference to FIGS. 1-5, a first embodiment of a pitch adjustable and/or bi-directional shovel 10 is shown. The shovel 10 generally includes a body or blade 12 that can be formed into an hourglass shape from any resilient material. The blade may include multiple edges (12*a*, 12*b*), walls (12*c*, 12*d*), and contact surfaces (12*e*-12*h*) that will be discussed in more detail below. The shovel 10 further includes a handle 13 and a pivot 14. Generally, the pivot 14 is disposed between the blade 12 and the handle 13 and can be secured to the shovel 10 through the use of a pair of pivot brackets 16 and a pivot pin 18. The pivot pin 18 passes through a pivot pin guide slot 19 in the handle 13, as is illustrated in FIGS. 3-5. In addition, the handle 13 may be biased in a rearward direction through the use of an alignment pin 20 (which is disposed partially within a bore 21 in the handle 13) and a biasing element or compression spring 22. In the instant embodiment, the biasing element is disposed between a portion of the handle 13 and the pivot 14 but can be placed in any location such that a bias is generated between the handle 13 and the blade 12.

The shovel 10 may further include an adjustable retention assembly 23 for retaining the pitch of the blade 12 at a particular angle with respect to the handle 13. The adjustable retention assembly 23 may include a first retention member or notch plate 24 and a second retention member or engagement pin 26. The notch plate 24 may include a plurality of notches 27 as is best illustrated in FIG. 4A-4D, As will be discussed in greater detail below, each of the plurality of notches 27 provides the user of the shovel 10 with a plurality of pitch configurations so as to be able to adjust the blade 12 in relation to the handle 13 for optimal debris removal. One example where such manipulation of the shovel 10 is beneficial is in difficult and hard to reach and/or confined spaces. In addition, a through slot 28 can be provided in the handle 13 so as to allow the notch plate 24 to move through the handle 13. Naturally, the notch plate and pin could be configured oppositely, anywhere along the handle, and/or internally or externally to the handle, etc.

It should be noted that a "T" pin can be formed when the pivot pin 18 is attached to the alignment pin 20 using a retainer 36. In such a case, the alignment pin 20 slides freely within the compression spring 22 and is seated against the pivot pin 18 to provide the pressure for the adjustable retention assembly (e.g., the pressure against pin 26 to keep the handle locked into the notches 27 on the notch plate 24 (FIG. 4A)).

Now, with reference to FIGS. 1-3, and as mentioned previously, the blade 12 may include a variety of walls (e.g., straight, angled from the middle to the front and/or back, etc.), edge features, and surfaces. In particular, the blade 12 includes a forward portion or edge 12*a*, a rearward portion or edge 12*b*, a first side portion or wall 12*c*, a second side portion or wall 12*d*, an upper surface 12*e*, and a lower or bottom surface 12*f*. In addition, both the forward and rearward edges 12*a*, 12*b* include corresponding contact surfaces 12*g*, 12*h*.

As illustrated in FIGS. 1-3, the side walls 12*c*, 12*d* extend upward from the upper surface 12*e* of the shovel blade 12 and are concave towards the central portion of the blade 12. The ends of the side walls 12*c*, 12*d* may taper from a first height near the center of the walls to a second height at the forward and rearward edges. The concavity of the side walls 12*c*, 12*d* allows the user to maneuver the shovel and blade portion 12 in a forward and rearward direction, with less interference or resistance, as would be encountered between a straight wall and the adjacent straight wall of an associated ash box of a furnace, for example. In addition, the side walls serve to capture and help retain any ashes and/or other debris that are collected on the upper portion or surface 12*e* of the blade 12 during the forward and rearward scooping or shoveling motions. Such reduction in resistance or interference is effected without losing any effective shovel width of the forward or rearward edges 12*a*, 12*b*.

In addition, the concavity of the side walls further optimizes the ash/debris collecting ability of the shovel blade since it provides an "escape" area where residual ashes may gather as the shovel is moved in either direction against the wall of the ash box or collection chamber. This helps prevent the shovel blade from being pushed away from the sides of the ash box/collection chamber due to compaction that would occur if the "escape" area did not exist. Furthermore, the concavity of the side walls also allows the ashes to gradually trail out from the shovel sides leaving a narrow window which provides an easier and cleaner extraction on the next stroke.

Any variety of manufacturing techniques can be employed in constructing shovel according to the present disclosure. For example, a press and a die can be used to form the geometry of the blade of the shovel. Drilling operations may be performed to size the bore for the compression spring and "T" pin. Milling operations may be performed to create the thru slots for the pivot pin and notch plate as well as the notches in the notch plate. Welding, riveting, etc. may be performed to secure the notch plate, pivot brackets, etc. to the blade or handle. In general, bar stock, plate, tubing, springs, and handle grip material can be used to fabricate the instant shovel.

With references to FIGS. 4A-4D, a more detailed discussion is provided of how the pitch adjustable aspect of the shovel is accomplished. Beginning with FIG. 4A, the shovel 10 (shown in partial section) is illustrated with the handle 13 being at the highest or upper most position and locked or engaged such that the blade 12 will not swivel about the pivot 14 during normal operation. In order to unlock or disengage the handle from the blade 12, the user pushes in the forward direction A (FIG. 4B) while holding the blade 12 in a fixed position or by maintaining some resistance against the forward edge 12*a*. Doing so, allows the handle 13 and the engagement pin 26 to move forward with respect to the blade 12 by compressing the spring 22 between the pin 18 and the handle 13 and allowing pin 18 to travel within the guide slot 19.

As illustrated in FIG. 4C, the user can then pivot or rotate the handle portion with respect to the blade 12 in a downward direction B until the desired level is reached. Once desired height or pitch is obtained, the user then allows the handle 13 to move in a rearward direction C (FIG. 4D), thereby allowing the biasing element or spring 22 to push the handle in the direction C with respect to the pivot 14. At this point, the engagement pin 26 is aligned with one of the notches of the plurality of notches 27 in the notch plate 24 and allowed to fully nest within the aligned notch. It should be noted that the slot 28 in the handle 13 is of an appropriate length and width so as to permit the notch plate 24 or other retention member to pass without obstruction through the full range of available pitch/notch settings. It should also be noted that alignment pin 20 travels forward and rearward during this process within the bore 21 provided in the handle 13. The alignment pin helps maintain the handle 13 in proper alignment with respect to the blade through the range of pitch settings (e.g., the handle should be generally perpendicular to the forward and rearward edges of 12*a*, 12*b* of the blade).

Figure 6A:
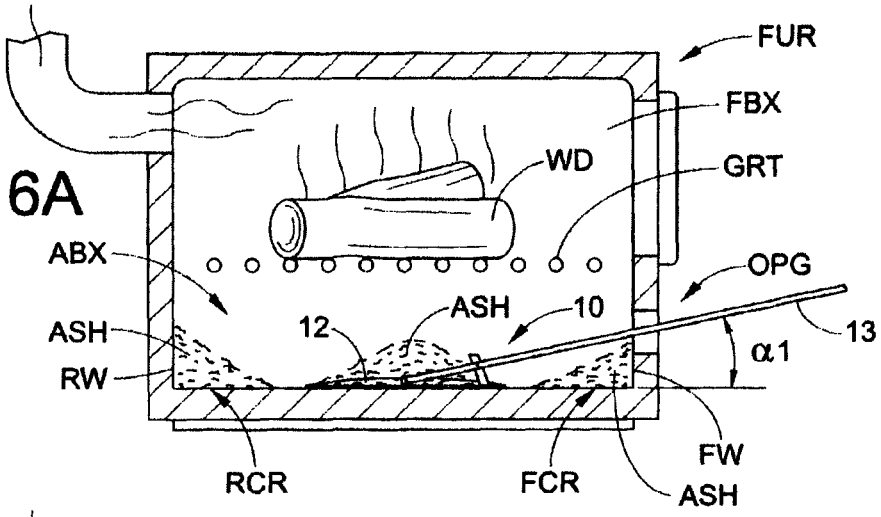
FIG. 6A is a cross section of a typical wood burning furnace/stove illustrating an ash box containing ashes in addition to the shovel of FIG. 1 having been inserted through an opening in the furnace into the ash box.
Figure 6B:
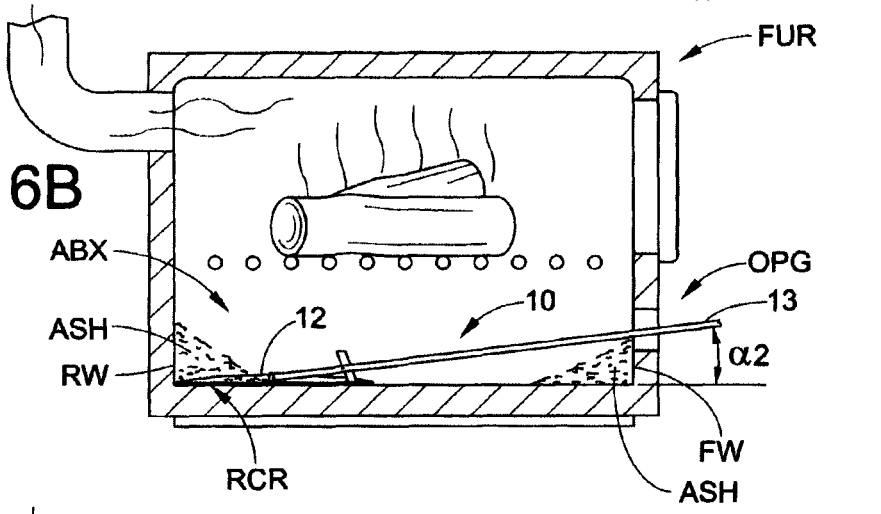
FIG. 6B is similar to FIG. 6A, except that the shovel of FIG. 1 is illustrated in a forward or extended position.
Figure 6C:
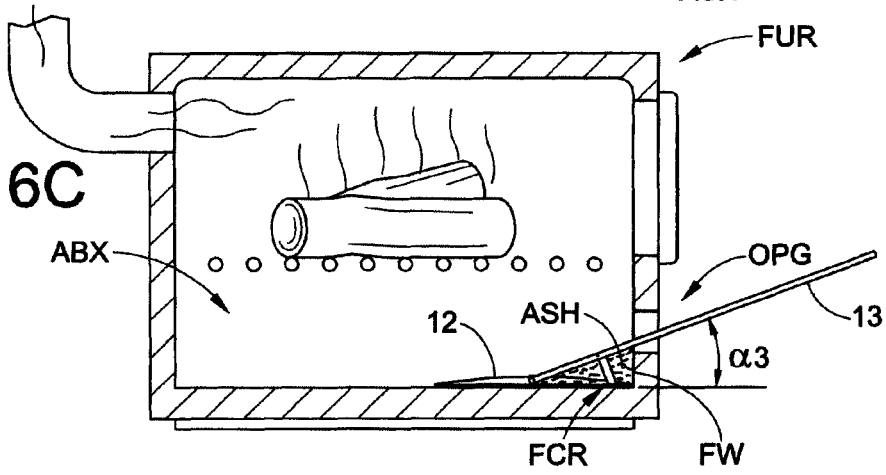
FIG. 6C is similar to FIG. 6A, except that the shovel of FIG. 1 is illustrated in a rearward or retracted position.

Now with reference to FIGS. 6A-6C, a typical cycle of operation of the pitch adjustable and/or bi-directional shovel 10 will be explained. FIG. 6A illustrates a typical stove or furnace FUR for burning wood, coal, pellets or any other like material. The furnace FUR includes a firebox FBX for burning the fuel. In this case, a piece of burning wood WD is shown. As is well known, during the combustion process of such fuels, various combustion gases and other bi-products result. Part of the bi-products involve ash ASH which fall through a grate GRT into an ash box ABX. An opening OPG is commonly provided in such furnaces FUR for the removal of the various solid bi-products that result from the combustion process. The opening OPG varies in height and width from manufacturer to manufacturer but is nearly always quite small and narrow. As such, the conventional user of such a furnace must expend great effort and time in cleaning the ashes from such a small, cumbersome, and/or confined space using a conventional (fixed pitch uni-directional) shovel. In particular, ashes tend to collect in the forward corner FCR, the side corners (not shown), and rear corner RCR of the ash box ABX. These locations tend to be the most difficult to clean due to their extreme positions (i.e., either just immediately within the opening OPG along the front of the furnace FUR or at the extreme opposite end towards the rear portion of the furnace FUR).

The shovel of the present disclosure is particularly adapted to effectively and efficiently clean and/or remove the various combustion products, such as the ash ASH from the ash box ABX in even the most extreme forward and rear positions within the furnace FUR due to its adjustable pitch and/or bi-directional features. By way of example only, this can be accomplished by first placing the shovel 10 through the opening OPG with the shovel at a first pitch setting indicated by the angle $\alpha_1$. Created between the generally planar surface of the blade and the handle. Once the blade 12 is positioned along the bottom of the ash box ABX, the user may push the handle portion 13 in the forward or rearward direction thereby slideably engaging the respective forward or rearward edge 12*a*, 12*b* and contact surfaces 12*g*, 12*h* (FIGS. 1-4D) of the blade 12 along the bottom of the ash box ABX. In doing so, ash and/or other debris is collected until the forward or rearward edge encounters an obstruction, such as the forward wall FW or rear wall RW of the ash box ABX (as shown in FIGS. 6B and 6C).

At this point, the user may elect to remove the shovel 10 and dispose of the ash collected by the blade 12. Upon reinsertion, the user may elect to change the pitch of the blade angle $\alpha$. This can be accomplished by pushing the shovel to either extreme in the ash box ABX or until an adequate resistance is met so as to hold the blade 12 of the shovel 10 in a generally fixed position. As the user continues to push on the handle 13, the engagement pin 26 will eventually disengage from the notch plate 24 allowing the user to select a different pitch angle. Once the new desired pitch is obtained (by raising or lowering the handle) the user releases the handle 13 causing the engagement pin to re-engage the notch plate. Now the user can better reach the extreme positions and corners FCR, RCR of the furnace FUR as illustrated in FIGS. 6B and 6C. As illustrated in FIG. 6B, a second lower pitch angle $\alpha_2$ of the blade 12 allows the user to best reach the extreme rear position or corner RCR. Similarly, as illustrated in FIG. 6C, a third higher pitch angle $\alpha_3$ of the blade 12 allows the user to best reach the extreme forward position or corner FOR. In this manner, the user can continue to readjust the height necessary quickly and effectively in order to reach the difficult and otherwise hard to access portions of compact or other the confined spaces through the use of a variety of pitch angles. In addition, the user may utilize both the forward and rearward edges of the shovel to remove ash or debris in a bi-directional manner thus reducing the number of insertion/extraction cycles necessary extract all of the debris. This effectively reduces the time required to remove the unwanted ash or debris by at least 50%.

Figure 7A:
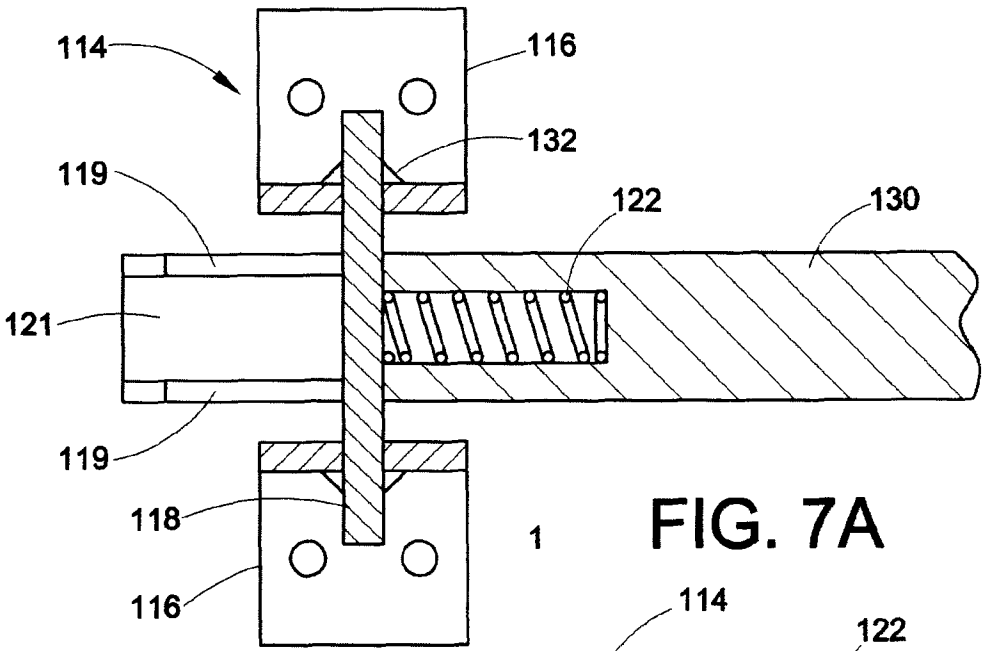
FIG. 7A is a top view of a pivot assembly of a second embodiment of a pitch adjustable and/or bi-directional shovel shown in partial cross section, according to the present disclosure.
Figure 7B:
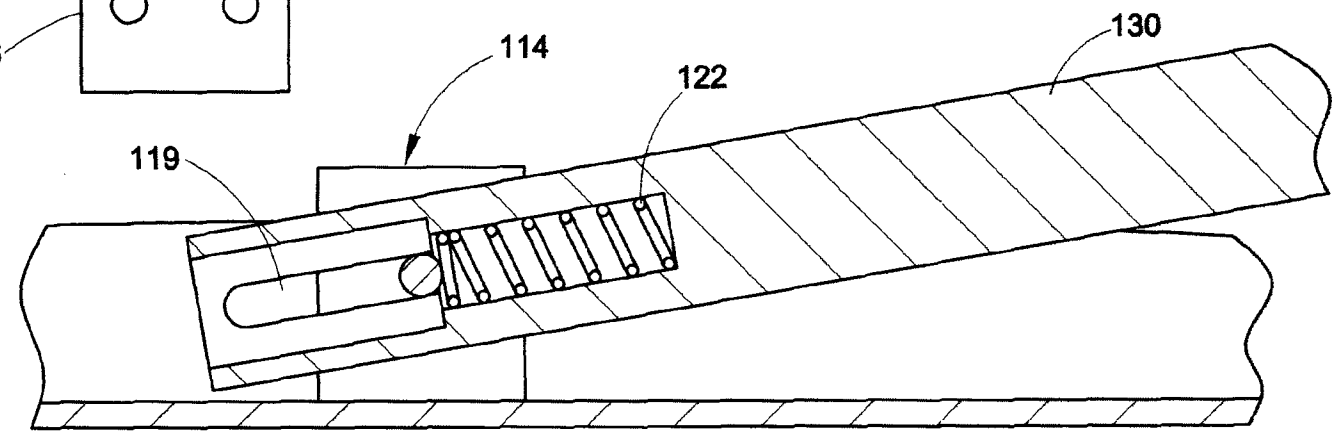
FIG. 7B is a side view of the pivot assembly of FIG. 7A shown in partial cross section.

Now with reference to FIG. 7, a second embodiment of a pivot assembly 114 is shown which, as with the first embodiment, includes a pair of pivot brackets 116, a pivot pin 118, a guide slot 119, a bore 121, and a spring or biasing member 122 disposed within the bore 121 of a handle 130. Of notable difference between the second embodiment of the pivot 114 and the first embodiment of the pivot 14 is the removal of the alignment pin 22 and the retainer 36. Instead, a pair of retaining clips 132 is provided, one on either end of the pivot pin 118 to prevent the pin from moving or otherwise falling out of the brackets 116 and to maintain the general perpendicularity of the handle with respect to the blade edges. However, the pivot assembly 114 still allows the handle 130 to rotate about the pin 118 and move forward and rearward so order to accommodate the adjustable pitch retention assembly.

Figure 8A:
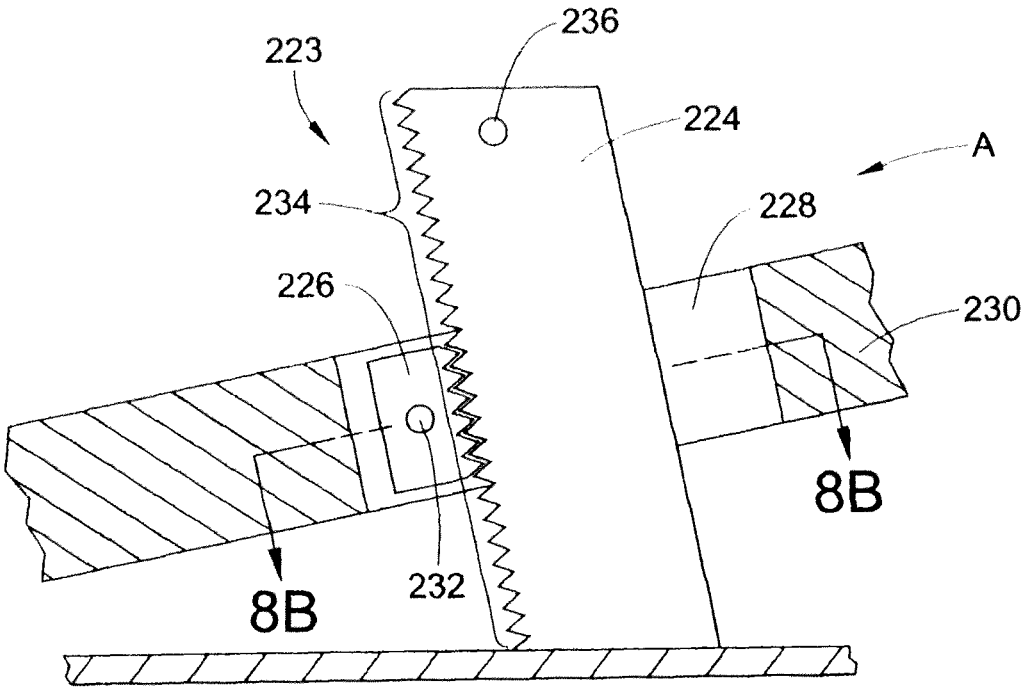
FIG. 8A is a side view of an adjustable retention assembly of a third embodiment of a pitch adjustable and/or bi-directional shovel shown in partial cross section, according to the present disclosure.
Figure 8B:
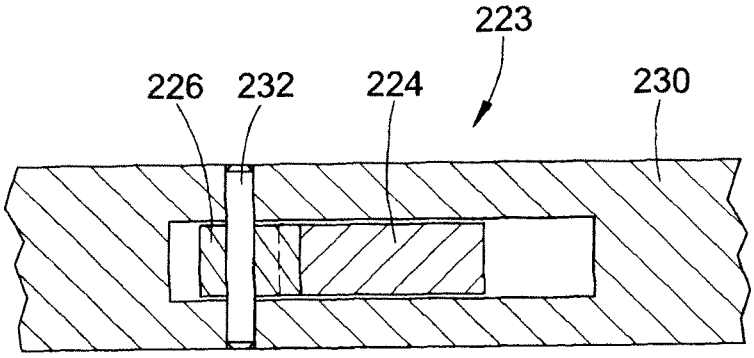
FIG. 8B is a top view of the adjustable retention assembly of FIG. 8A shown in partial cross section.

Now with reference to FIGS. 8A and 8B, another embodiment of an adjustable retention assembly 223 is shown. The adjustable retention assembly 223 includes a first retention member or rack 224 and a second retention member or rack 226 disposed within a slot portion 228 of the handle 230. A pin 232 is used to secure the second rack member 226 to the handle 230 while allowing it to rotate about the pin 232. Both the first and second rack members 224, 226 include a plurality of teeth 234 which provide a higher degree of pitch resolution and height control in obtaining the desired setting most optimal for debris removal within the confined space discussed previously. In addition, a pin 236 or other retaining member can be used in the first rack member 224 to prevent the handle portion 230 from escaping or extending beyond the upper portion of the first rack member 224. In much the same way as discussed with regard to the first embodiment, a change in height or pitch position is accomplished by pushing the handle 230 in a forward direction A thereby disengaging the teeth 234 as between the first and second rack members 224, 226. The handle 230, being disengaged from the first rack member 224, can be pivoted upward or downward to the next height or pitch setting. As before, releasing the handle will allow the first and second rack members to once again mesh effectively retaining the handle and the blade at the desired height/pitch setting.

Figure 9A:
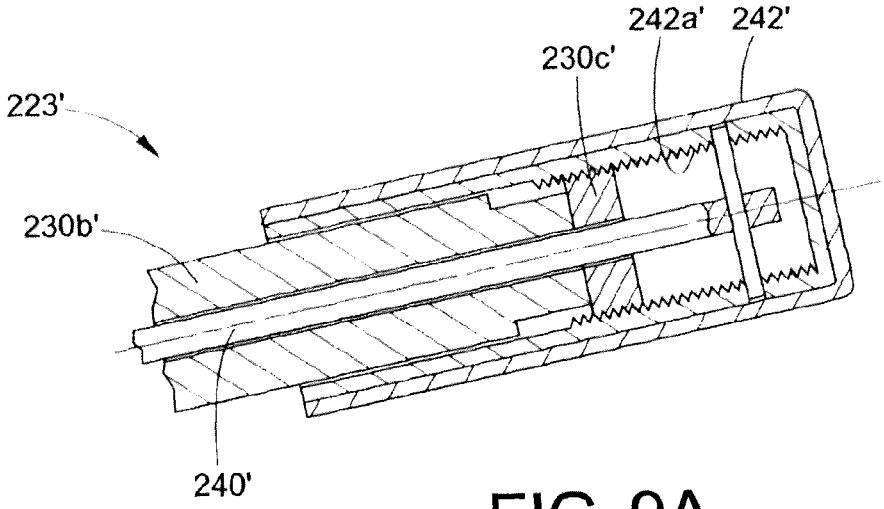
FIG. 9A is a side view of an upper portion of an adjustable retention assembly of a fourth embodiment of a pitch adjustable and/or bi-directional shovel shown in partial cross section, according to the present disclosure.
Figure 9B:
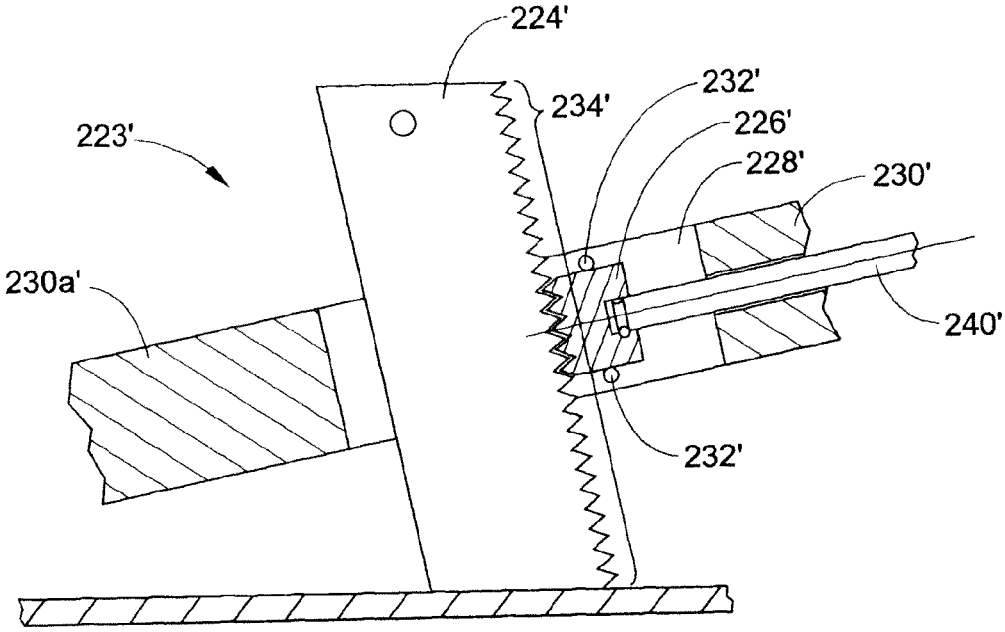
FIG. 9B is a side view of a lower portion of the adjustable retention assembly of the fourth embodiment shown in partial cross section.

With reference to FIGS. 9A and 9B, yet another embodiment of an adjustable retention assembly 223' is shown. As with the previously disclosed adjustable retention assembly 223 (FIGS. 8A and 8B), the adjustable retention assembly 223' includes a first retention member or rack 224' and a second retention member or rack 226' disposed within a slot 228' at a lower end 230*a'* of the handle 230'. However, rather than the second rack being pinned to the handle 230', the second rack 226' of the instant embodiment can be slideably mounted to the handle 230' between one or more guide pins 232'. In this case, the second rack member 226' slides generally linearly with respect to the handle 230' permitting a plurality of teeth 234' of the respective rack members 224', 226' to be engaged and disengaged. The second rack member 226' can be urged in a forward or rearward direction through the use of a rigid push rod 240' which may be rotatably mounted to the second rack member 226' and disposed within a bore of the handle 230'. The push rod 240' extends to a threaded locking assembly in an upper end 230*b'* of the handle 230'. The threaded locking assembly may include a grip portion 242' that is rotatably secured to the upper end 230*b'* of the handle 230'. As the grip portion 242' is rotated, a first threaded member or internally threaded portion 242*a'* of the grip portion 242' reacts against a second threaded member or externally threaded portion 230*c'* which is fixed with respect to the handle 230'. It should be noted that in the instant embodiment, the blade end of the handle 230' can be attached to the shovel or blade portion using a non-sliding end pivot (as opposed to the pivot configurations of the first and second embodiments which allowed the handle to slide with respect to the blade portion of the shovel).

With continued reference to FIGS. 9A and 9B, if conventional right-hand threads are used then rotating the grip portion 242' in a clockwise direction (as viewed from the end of the handle 230') would cause the grip portion 242', push rod 240', and second rack member 226' to move in a forward direction (towards the first rack member 224') thereby creating a clamping pressure between the sets of teeth 234' of the respective rack members 224', 226'. Rotating the handle in the opposite direction would naturally create the opposite effect of backing the second rack member 226' away from the first rack member 224' and loosening the handle 230' with respect to the blade. When the handle is in this 'loosened' state, it can then be rotated up or down about the non-sliding end pivot. As such, the angle/pitch of the handle (relative to the blade) can be adjustably retained in multiple height/pitch configurations, as discussed above with respect to the previous embodiments.

Figure 10A:
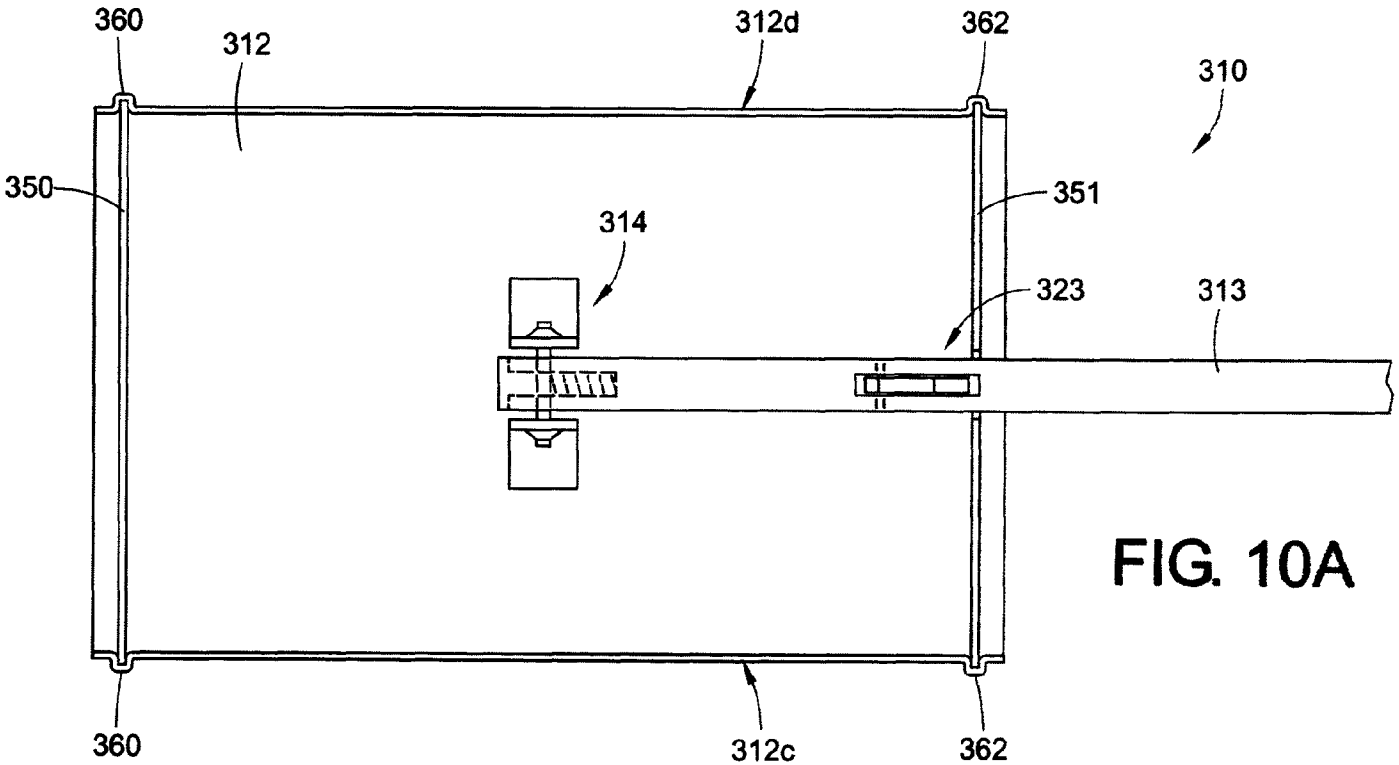
FIG. 10A is a top view of a fifth embodiment of a pitch adjustable and/or bi-directional shovel, according to the present disclosure.
Figure 10B:
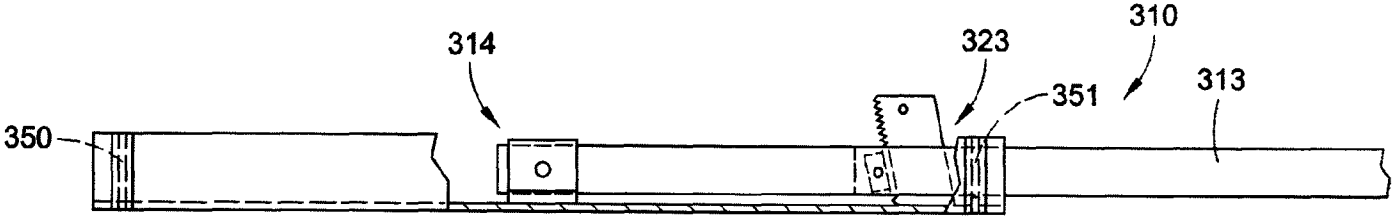
FIG. 10B is a side view of the shovel of FIG. 10A.

Now with reference to FIGS. 10A and 10B, still yet another embodiment of a shovel 310 is shown. In this embodiment, the shovel 310 includes a blade 312, a pivot assembly 314, an adjustable retention assembly 323, and a handle 313. As shown, the geometry of the blade 312 of the instant embodiment is different than the blade 12 of the first embodiment. One notable distinction is the inclusion of a forward plate 350 and a rearward plates 351. The plates 350, 351 may be selectively seated in a pair of retaining channels 360 and 362 formed into a pair of side walls 312*c*, 312*d*. This affords the user the flexibility of selectively converting the shovel 310 into a uni-directional shovel. In other words, by removing the forward plate 350 and installing the rearward plate 351, the shovel 310 is converted into a forward only debris collection shovel. Similarly, by installing the forward plate 350 and removing the rearward plate 351, the shovel 310 is converted into a rearward only debris collection shovel.

Figure 11A:
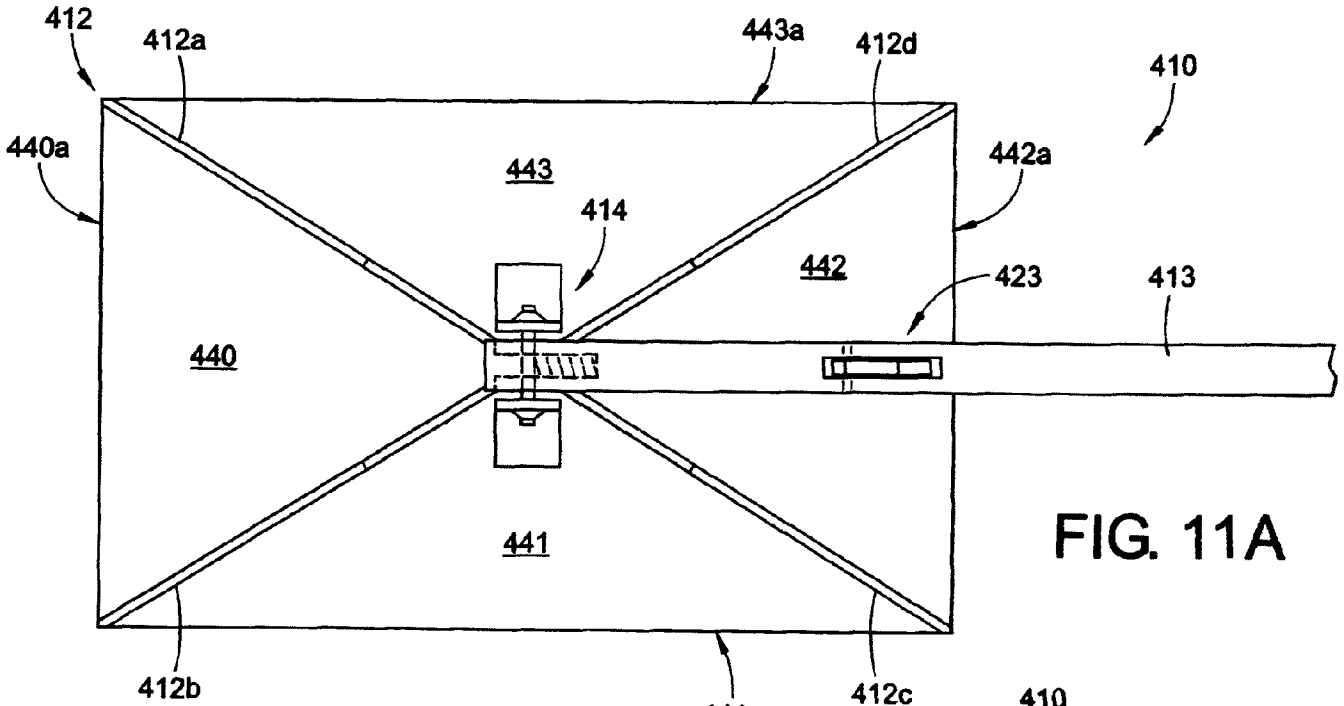
FIG. 11A is a top view of a sixth embodiment of a pitch adjustable and/or bi-directional shovel, according to the present disclosure.
Figure 11B:
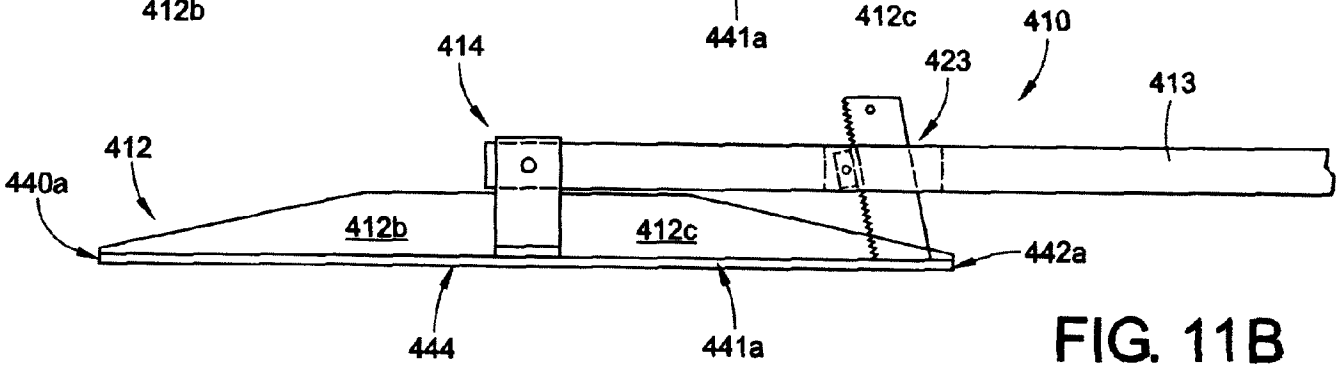
FIG. 11B is a side view of the shovel of FIG. 10A.

Finally, with reference to FIGS. 11A and 11B, yet another embodiment of a pitch adjustable shovel 410 is illustrated. However, one primary difference is that while the previously described embodiments were selectively bi-directional, the shovel 410 of the instant embodiment is actually multi-directional. As with the previous embodiments, the shovel 410 includes a blade portion 412 and a portion 413, a pivot portion 414, as well as a retention assembly 423. Of notable distinction is the blade geometry 412 which includes a plurality of walls 412*a*-412*d* for defining a plurality of debris retention departments 441-443. As with the first embodiment, the blade 412 includes a plurality of edges 440*a*-443*a*. In particular, the blade 412 includes a forward edge 440*a*, a first side edge 441*a*, a rear edge 442*a*, and a second side edge 443*a*. Having the additional side edges 441*a*, 443*a* provides for greater flexibility in being able to obtain debris components in confined spaces in a sideways or diagonal manner. As such, the shovel 410 can be moved in any direction along the debris laden surface of the debris compartment and still effectively collect debris. In addition, the walls 412*a*-412*d* not only effectively stiffen the blade 412 and provide for substantially flat bottom surface 444, but also serve, as noted previously, to define multiple debris compartments for maximum debris extraction and to prevent debris from unintentionally sliding off when the shovel 410 is being maneuvered into and out of various spaces.

As should be apparent from the above description, at least one object of the shovel of the present disclosure is to provide a way to clean the ashes, burnt matter, and/or other debris from the corners of the debris compartment or collection area of coal and wood stoves, furnaces, etc. in a more efficient manner than provided for by the prior art shovel devices. One way such efficiency may be achieved is by using an adjustable retention mechanism or assembly that easily adjusts the pitch of the shovel head or blade in relation to the handle to obtain the best possible angle to remove the ashes, burnt matter, and/or other debris from debris compartment or collection area of the stove or furnace. Another way such efficiency may be achieved is by implementing a blade geometry that permits for the collection or accumulation of debris on the blade in multiple directions (e.g., forwards, rearwards, and/or sideways) without the user having to substantially change the orientation of the shovel with respect to the user (i.e., the user need not flip or turn the shovel around, upside down, on edge, etc.) in order to effectively collect debris in a different direction.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A pitch adjustable ash shovel for removing ash debris from an associated ash laden surface, the adjustable ash shovel comprising:

a blade comprising a transverse forward edge and a transverse rear edge, the forward and rear edges of the blade comprising respective forward and rear contact surfaces for slideably engaging the associated ash laden surface, the blade further comprising a first side wall and a second side wall, wherein the first and second side walls are concave such that that the blade is wider at said forward and rear edges and narrower between said forward and rear edges;

a pivot secured to the blade between the forward and rear edges, the pivot comprising an axis of rotation;

a handle including a first end and a second end, the first end being rotatably mounted to the pivot for rotation of said handle relative to said blade about said axis of rotation;

a retention assembly secured to one or more of the pivot, the blade, or the handle;

wherein the pivot and the retention assembly cooperate to alter the pitch of the blade with respect to the handle; and, wherein said handle is selectively movable from a first position in which said retention assembly is engaged with said handle and secures said handle at a select pitch relative to said blade to a second position in which said handle is disengaged from said retention assembly and said pitch of said handle relative to said blade is adjustable by rotational movement of said handle relative to said blade about said axis of rotation.

2. The adjustable ash shovel of claim 1, wherein the blade is substantially flat.

3. A pitch adjustable ash shovel for removing ash debris from an associated ash laden surface, the adjustable ash shovel comprising:

a blade comprising a transverse forward edge, the forward edge of the blade comprising a contact surface for slideably engaging the associated ash laden surface;

a pivot secured to the blade, the pivot comprising an axis of rotation generally parallel to the forward edge of the blade;

a handle including a first end and a second end, the first end being rotatably mounted to the pivot;

an adjustable retention assembly secured to one or more of the pivot, the blade, or the handle;

wherein the pivot is slideably engaged in a slot in the first end of the handle; and, wherein the pivot and the adjustable retention assembly cooperate to alter the pitch of the blade with respect to the handle.

4. The adjustable ash shovel of claim 3, wherein the handle includes a biasing element operatively disposed between the pivot and the handle.

5. The adjustable ash shovel of claim 4, wherein the adjustable retention assembly includes a notch plate and a notch pin, the notch plate being secured to one of the handle or the blade and the notch pin being secured to the other of the handle or the blade, the notch pin being selectively engageable with one of a plurality of spaced apart notches in the notch plate so as to incrementally adjust a pitch angle of the blade with respect to the handle.

6. The adjustable ash shovel of claim 4, wherein the adjustable retention assembly includes a first rack member and a second rack member, the first rack member being secured to one of the handle or the blade and the second rack member being secured to the other of the handle or the blade, a plurality of teeth of the first rack member being selectively engageable with a plurality of teeth of the second rack member so as to incrementally adjust a pitch angle of the blade with respect to the handle.

7. The adjustable ash shovel of claim 4, wherein the adjustable retention assembly includes a threaded locking assembly, the threaded locking assembly including a first threaded member and second threaded member, the first threaded member being rotatably secured to the handle and the second threaded member being fixed with respect to the handle, such that a rotation of the first threaded member about a longitudinal axis of the handle either tighten or loosens the handle with respect to the blade.

8. A pitch adjustable bi-directional shovel for the removal of debris from an associated debris laden surface, the shovel comprising:

a substantially flat blade including a forward edge and a rearward edge, each of the forward edge and the rearward edge of the blade comprising a contact surface for slideably engaging the associated debris laden surface;

a pivot secured to the blade;

a handle including a first end and a second end, the first end being rotatably mounted to the pivot;

an adjustable retention assembly secured to one or more of the pivot, the blade, or the handle, wherein the pivot and the adjustable retention assembly cooperate to alter the pitch of the blade with respect to the handle so as to maintain the blade in general parallel orientation with the associated debris laden surface; and wherein the contact surface of the forward edge slideably engages the associated debris laden surface when urged in the forward direction and the contact surface of the rearward edge slideably engages the associated debris laden surface when urged in the rearward direction, thereby accumulating the associated debris on the blade of the shovel in both of the forward and rearward directions; and, wherein the blade includes a plurality of walls disposed along an upper surface of the blade that define a plurality of debris retention compartments.

* * * * *